US006990773B2

(12) United States Patent
Borges

(10) Patent No.: US 6,990,773 B2
(45) Date of Patent: Jan. 31, 2006

(54) FLEXIBLE REFLECTIVE SKYLIGHT TUBES

(76) Inventor: Michael Borges, 19049 Janisse La., Lake Elsinore, CA (US) 92530

( * ) Notice: Subject to any disclaimer, the term of this patent is extended or adjusted under 35 U.S.C. 154(b) by 550 days.

(21) Appl. No.: 09/814,109

(22) Filed: Jun. 29, 2001

(65) Prior Publication Data

US 2003/0000158 A1 Jan. 2, 2003

(51) Int. Cl.
*E04B 7/18* (2006.01)

(52) U.S. Cl. ..... 52/200; 52/28; 52/199

(58) Field of Classification Search ..... 52/199, 52/200, 28

See application file for complete search history.

(56) References Cited

U.S. PATENT DOCUMENTS 4,339,900 A * 7/1982 Freeman ..... 52/200
5,099,622 A * 3/1992 Satton ..... 52/200
5,435,780 A * 7/1995 Ayles ..... 454/199
5,502,935 A * 4/1996 Demmer ..... 52/200
5,546,712 A * 8/1996 Bixby ..... 52/200
5,596,848 A * 1/1997 Lynch ..... 52/200
5,655,339 A * 8/1997 DeBlock et al. ..... 52/200
5,716,442 A * 2/1998 Fertig ..... 136/246
5,878,539 A * 3/1999 Grubb ..... 52/200
5,896,712 A * 4/1999 Chao ..... 52/200
5,896,713 A * 4/1999 Chao et al. ..... 52/200
5,983,581 A * 11/1999 DeBlock et al. ..... 52/200
6,035,593 A * 3/2000 Chao et al. ..... 52/200
6,178,707 B1 * 1/2001 Bengston ..... 52/200
6,219,977 B1 * 4/2001 Chao et al. ..... 52/200
6,256,947 B1 * 7/2001 Grubb ..... 52/200
6,321,493 B1 * 11/2001 Rillie et al. ..... 52/200

* cited by examiner

*Primary Examiner*—Carl D. Friedman
*Assistant Examiner*—Yvonne M. Horton

(57) ABSTRACT

This invention relates to a flexible light conduit having two ends, one end mounted to an outdoor support such as a roof and at it's other end to a ceiling or other support inside a structure such as a house, garage, shed or other structure, said light conduit being of any shape in cross section, preferably square or rectangular and lined with any material or combination of materials for insulation, ornamentation and the like.

4 Claims, 1 Drawing Sheet

FLEXIBLE REFLECTIVE SKYLIGHT TUBES

BACKGROUND OF THE INVENTION

The present invention relates to skylights and, more particularly, to a skylight system with a tubular light conduit connecting to a roof skylight device to a ceiling skylight device.

Roof skylights are a means to provide daylight into a room with limited amounts of available daylight. Usually, such rooms have no windows or one window. Townhouses or row houses in particular are faced with light limitations, except for end units, they only receive sun light from two directions. As the earth rotates about the sun and depending on which direction a house faces, a room may receive a lot or a little sunlight. To overcome the limited available sunlight coming into a room, skylights were invented.

The early skylights had metal frames and glass panes with wire mesh embedded in the panes for safety purposes. The skylight was mounted on a roof over a shaft leading from the roof to a ceiling. Generally, the shaft was covered with wood or plaster board. The problem is that the sunlight reflects off the shaft, which has been painted, some of the light is absorbed, particularly when the angle of the sunlight is low. Another problem is when a skylight and shaft are added after a house is built, the alignment of a skylight opening and a ceiling opening may be off.

Recent developments of skylights, including the patented art, use modern materials to create skylights. With the use of modern plastics, sunlight at any angle cap be reflected through a skylight shaft into a room and skylights can be bent to align a skylight shaft with a skylight opening and a ceiling opening.

A patent of interest to the present invention is U.S. Pat. No. 5,502,935, issued to Demmer. In the Demmer disclosure, a skylight, shown in FIG. 1 has a skylight module 12 and a ceiling mounted fixture module 16 connected by a flexible, tubular, light conveyance module 20. The flexible, tubular light conveyance module 20 has an inner wall portion 54, an outer wall portion 56, and a middle portion on an insulation material 58. The inner wall portion 54 is white to facilitate light reflection. Both the inner and outer wall portion 54 and 56, respectively, are made of a durable, flexible vinyl material. The middle portion 58 insulation is an injected foam, fiberglass or any other known, flexible insulating material.

For the purposes of the present invention, Demmer provided the flexible, tubular light conveyance module with a series of pleats 52 to facilitate bending into alignment with the skylight module 12 and the ceiling mounted fixture module 16. Module 20 can be reinforced with a wire spiral.

Demmer also discusses the use of flexible, tubular light conveyance modules 20 of circular, rectangular or other shape in cross-sections.

SUMMARY OF THE INVENTION

The present invention relates to a light and air conducting tube which connects between a skylight and a ceiling opening through an attic or like space between the roof and the ceiling of a house. The light and air conducting tube is somewhat flexible to allow bending of the tube to match the locations of a skylight and a ceiling opening should they not be aligned. At the same time the tube is firm enough to not collapse under its own weight. The inner surface of the light and air conducting tube has a highly reflective tube for greater light transmission. To further increase the amount of light transmitted, the tube has a square or rectangular cross-section, which increases the area approximately 27% more than a circle.

The construction of the light and air tube includes a reflective liner of a suitable plastic, a center insulation, such as bubble wrap, and an outer liner of aluminum foil. This construction provides good light transmission, insulation against cold and heat, and a good fire retardant radiant barrier.

The skylight has a dome covering the top opening, such dome is preferably white to further maximize the light transmitted to the interior of the building.

It is therefore and object of the present invention to provide a new and improved roof to ceiling skylight which may be easily manufactured as a reasonable cost.

Another object of the present invention is to provide a skylight assembly that has the flexibility to bend and conform in an attic space to align with both a skylight and a ceiling opening.

It is a further object of the invention to provide a light and air tube with a light reflective inner wall, an insulation center core, and a fire retardant outer wall.

Still a further object of the present invention is to provide a new and improved roof to ceiling skylight apparatus which eliminates the need for a customized construction of a light conveyance between a roof-mounted skylight and a ceiling-mounted translucent fixture.

DESCRIPTION OF THE INVENTION

Figure 1:
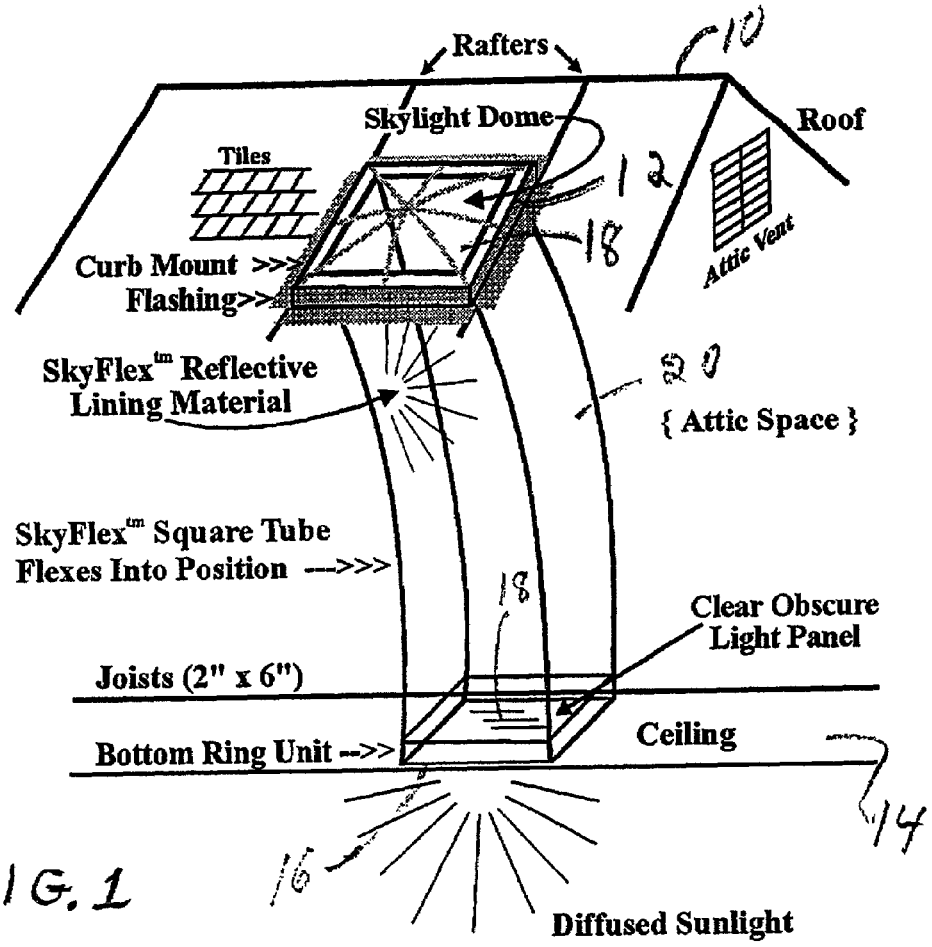
FIG. 1 shows the outline of a roof and a partial ceiling connected by a light and air conducting tube where one end of the tube is connected to a skylight and at the other end to a ceiling translucent or transparent fixture.
Figure 2:
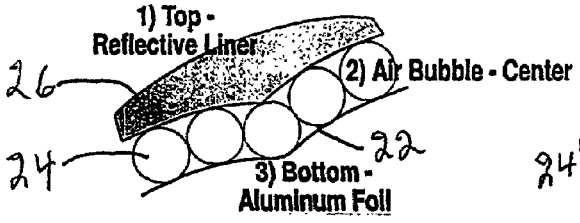
FIG. 2 shows a partial cross-section of a light and air conducting tube of the invention.
Figure 3:
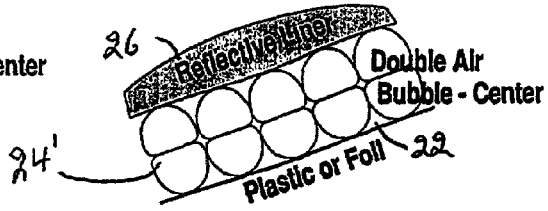
FIG. 3 shows another embodiment of a cross-section of a light and air conducting tube of the invention.

Referring to the drawings, FIGS. 1 to 3, there is shown the outline of a house or building roof 10, having a skylight 12, and a partial section of an interior ceiling 14 having an opening 16 covered by a light panel 18, a light and air conducting tube 20 connects the skylight 12 to the ceiling light panel 18. As can be seen, the skylight 12 and the ceiling light panel 18 are out of alignment. That is to say, they are not in vertical alignment therefore, the light and air conducting tube 20 is flexible in order to connect skylight 12 to ceiling light panel 18. While the tube 20 is flexible, it is still firm enough to support its own weight.

It is shown in FIG. 1, that the light and air conducting tube has a square or rectangular cross-section which among other things provides a larger light area than would a round or circular cross-section.

FIG. 2 shows a partial cross-section of a light and air conducting tube 20. Having an interior liner 22, a center insulation core 24 and an outside layer 26. The interior liner has metallized polyester such as WMP-50 building facing material by Lamtech or similar materials made by Alpha Associates, Inc. such as VR-R which use a white polypropylene (PP) film with a metallized polyester film backing and fiberglass scrim tear stopper. Alternately, the reflective coating can also be achieved by using a silver sputter process on various flexible plastic films or specialty film such as 3M Silverlux or the newer High Reflective Mirror Films. The main concern is to achieve the highest degree of light reflectance at the most economical cost. Currently a hot-melt glue is used to laminate the reflective liner to the "top side" of the Astro-Foil bubble wrap. This "top side" can be sealed with a plastic cap or alternately finished with aluminum foil if extra strength or firmness is desired.

The center insulation core 24 is made of 3/16 single polyethylene air bubble material (FIG. 1) or 3/8 polyethylene air bubble material (FIG. 2). The air bubble provides insulation from hot and cold air convection. Currently our preferred material in production is the single bubble (3/16") which is 0.1875 thick plus the WMP-50 reflective liner which is about 9 mils thick which with glue is about 0.200" thick (200 mils)-or one fifth of an inch. The combination of all of these materials provides a very firm composite that is highly compact for shipping, flexible for installation and suitably rigid after fabricating and installing in place as a skylight tube. The double-bubble material might be preferred for larger skylight tubes to enhance firmness (rigidity) or where more insulation is needed to meet more extreme temperature conditions. Outside layer 26 has a plastic cap usually extruded from the same material as the air bubble chambers lined with a commercial grade aluminum foil for strength and durability. The aluminum foil is typically 99% pure AL and acts as a barrier against radiant heat gain or loss from the invented skylight tube. The plastic cap is a minimum part of the bubble-wrap insulation material, but normally comes with aluminum foil bonded to at least one side. Although the aluminum foil is optional, it is the preferred construction method because of its inexpensive fire retardant radiant barrier advantages.

The light reflective material can by made of virtually any high polished metal of metallized film or metallized fabric material. There are at least several commercially available which are already fire related and/or ASTM or UL listed, etc. Currently a commercial grade metallized film is used with a polypropylene scrim weave core for added strength and durability such as WMP-50 by Lamtech. The key is to have the reflective material attached (bonded or laminated, etc.) to a firm-yet flexible backing which is also code and fire rated for use as building material, such as the above mentioned Astro-Foil bubble wrap. The bubble foil core 24 can range in thickness from about 1/8" to 1/4" thick (preferably 0.200" thick) but should consist of a firmness able to hold up it's own weight when held out about 24" in length or width. The suitable material should ideally insulate well and yet be flexible enough to be easily cut such as scissor trimmed for ease of installation. At the top and bottom it would be attached by staples or similar fastening means such as rivets, screws or tape. After installation, a quick hand or pole insertion would help unfold or open up any area(s) inside the tube such as around bends. The seam or seams could run where ever needed to accommodate standard and/or custom fit size runs. However, normally a seam would run parallel to the length of the tube for smaller tubes and for larger or longer tubes there may be more than one seam running either length wise or perhaps also two or more around the circumference of the tube to accommodate unique sizes. As mentioned before, the outside layer 26 of the tube is optional and can come with a reflective material as a further insulation barrier or may also come without it. The outside layer of reflective aluminum foil is being used in the current preferred embodiment.

In FIG. 3, a double air bubble core is shown to increase the insulation quality of the core 24'.

While only one embodiment of the invention has been shown, it is understood that one skilled in the art may realize other embodiments. Therefore, one should consider the drawings, description and claims in their entirety.

What is claimed is:

1. A new and improved skylight conduit for conducting light and air into a room, comprising:

a roof mounted skylight having a dome in the roof of a building aperture and capable of receiving light from said roof;

a ceiling mounted fixture for mounting in a ceiling aperture and capable of conveying light to the inside of a room;

a flexible light and air conducting tube capable of bending to connect said skylight to said ceiling mounted fixture, where said flexible light and air conducting tube has a reflective inner wall, an insulated center core and a fire retardant outer wall;

said reflective inner wall being an optically reflective material and said reflective inner wall being constructed of an air bubble material, and;

said fire retardant outer wall is a metal foil to provide fire retardant qualities and strength to support the weight of the flexible light and air conducting tube.

2. A new and improved skylight conduit as in claim 1 in which the conducting tube is square in cross-section.

3. A new and improved skylight conduit as in claim 1 in which the conducting tube is other than square in cross-section.

4. A new and improved skylight conduit as in claim 1, in which the ceiling mounted fixture is other than translucent.

* * * * *